US006957457B2

(12) United States Patent
Stryker et al.

(10) Patent No.: US 6,957,457 B2
(45) Date of Patent: Oct. 25, 2005

(54) PATIENT SUPPORTING APPARATUS WITH LIQUID COLLECTING RECEPTACLE

(75) Inventors: Martin Stryker, Kalamazoo, MI (US); Mike Hernandez, Kalamazoo, MI (US); William Bleeker, Jr., Plainwell, MI (US); Jeff Lewandowski, Delton, MI (US)

(73) Assignee: Stryker Corporation, Kalamazoo, MI (US)

( * ) Notice: Subject to any disclaimer, the term of this patent is extended or adjusted under 35 U.S.C. 154(b) by 61 days.

(21) Appl. No.: 10/763,851

(22) Filed: Jan. 23, 2004

(65) Prior Publication Data

US 2004/0148705 A1 Aug. 5, 2004

Related U.S. Application Data

(62) Division of application No. 10/192,405, filed on Jul. 10, 2002, now Pat. No. 6,725,479.

(51) Int. Cl.[7] ..... A61G 7/00
(52) U.S. Cl. ..... 5/602; 5/606; 604/322
(58) Field of Search ..... 5/602, 606; 604/322

(56) References Cited

U.S. PATENT DOCUMENTS 679,802 A 8/1901 Vaughan
3,328,024 A * 6/1967 Weil ..... 5/606
4,411,035 A * 10/1983 Fenwick ..... 5/602
4,615,058 A * 10/1986 Feldt ..... 5/602
4,639,954 A * 2/1987 Speed ..... 5/602
4,821,350 A * 4/1989 Feldt ..... 5/602
5,078,705 A * 1/1992 Edwards et al. ..... 604/322
5,214,812 A 6/1993 Bartow et al.
5,226,187 A 7/1993 Borders et al.
6,282,738 B1 9/2001 Heimbrock et al.
6,408,464 B1 6/2002 Weismiller et al.

* cited by examiner

*Primary Examiner*—Michael Trettel
(74) *Attorney, Agent, or Firm*—Flynn, Thiel, Boutell & Tanis, P.C.

(57) ABSTRACT

A bed having a base, a pedestal oriented between a top side of the base and a patient support deck to facilitate elevational movement of the support deck. The patient support deck includes a seat section which includes a deck plate. A pair of laterally spaced support brackets are provided on the patient support deck. Coupling elements are supported on each of the support brackets. Separate patient supporting devices are configured to operatively connect to a selected one of the two coupling elements is provided. A guideway is provided on each of the support brackets, the guideway supporting a frame and having a track thereon. A receptacle is mounted on the track and for movement relative to the frame, the receptacle being stowable beneath the deck plate and deployable so that the receptacle is oriented immediately below the perineal edge of the seat section.

14 Claims, 11 Drawing Sheets

PATIENT SUPPORTING APPARATUS WITH LIQUID COLLECTING RECEPTACLE

This is a division of Ser. No. 10/192,405, filed Jul. 10, 2002, now U.S. Pat. No. 6,725,479.

FIELD OF THE INVENTION

This invention relates to a patient supporting apparatus for use in surgical procedures and, more particularly, to a patient supporting bed having multiple attachments for facilitating multiple uses of the patient supporting bed.

BACKGROUND OF THE INVENTION

Wheel supported beds for use in patient care have become more and more sophisticated and more versatile. Beds used as patient supports are now being used to transport patients from a room in which patient care is provided to other facilities within a health care establishment without necessitating removal of the patient from the bed. One of the uses includes a use in a surgical theatre and for multiple types of surgery, such as head, neck and shoulder surgery as well as urological surgeries. The needs of the surgeon for the aforesaid types of surgeries are multiple and are often not available on a single patient supporting bed thereby necessitating the purchase of multiple styles of patient supports in order to accommodate each particular need.

Accordingly, it is an object of this invention to provide a patient supporting bed having multiple features capable of operative connection to the bed to facilitate multiple and differing uses for the bed, such as surgeries to be performed upon the patient.

It is a further object of the invention to provide a patient supporting bed, as aforesaid, wherein the patient supporting deck thereof includes a head, seat and foot section with the foot section being composed of two components separately and independently connected to the bed on the edge of the seat remote from the head section.

It is a further object of the invention to provide a patient supporting bed, as aforesaid, wherein there is provided a fluid receiving receptacle oriented in a normally stowed position beneath the seat section and being deployable to a position immediately below the perineal edge of the seat section, that is, the edge of the seat section remote from the head section.

It is a further object of the invention to provide a patient supporting bed wherein one of the foot sections serves as a foot end fowler capable of mimicking the articulation of the head section so that a patient supported on the seat section will have the feet supported on the head section and the back resting against the foot end fowler.

It is a further object of the invention to provide a patient supporting bed, as aforesaid, wherein the structure of the overall bed in the area beneath the foot section is completely open so as to provide an unobstructed space for the surgeon to use during surgical procedures.

It is a further object of the invention to provide a patient supporting bed having support rails extending coextensively along opposite side edges of the patient support deck and capable of mounting various accessories, such as side rails and/or patient leg supports and the like.

SUMMARY OF THE INVENTION

The objects and purposes of the invention are met by providing a patient supporting apparatus in the form of a bed having a base, a pair of elongate generally parallel extending and laterally spaced support frame members on the base. A pedestal is oriented between a top side of the base and each of the support frame members to facilitate elevational movement of the support frame members. A patient support deck is mounted on the support frame members and includes a head section and a seat section, the seat section including a deck plate oriented in a horizontal plane mounted to and extending between the support frame members. A pair of laterally spaced support brackets are provided on either the base or the patient support deck adjacent to the seat section along a side thereof remote from the head section.

The above set forth patient supporting apparatus is capable of operatively connecting to various components. In order to facilitate this operative connective relation, the patient supporting apparatus includes a fastening member having separate first and second coupling elements thereon supported on each of the support brackets for movement between two positions. Separate first and second patient supporting devices each having an attachment member configured to operatively removably and separately connect only to a selected one of the two coupling elements is provided. The first patient supporting device is a foot section supported on a first of the coupling elements. The second patient supporting device is a foot end fowler section supported on a second of the coupling elements.

The aforesaid patient supporting apparatus also includes a guideway on each of the support brackets, the guideway supporting a frame and having a track thereon. A receptacle is removably mounted on the track and for movement relative to the frame, the receptacle being stowable beneath the deck plate and deployable so that the receptacle is oriented immediately below the perineal edge of the seat section.

BRIEF DESCRIPTION OF THE DRAWINGS

Other objects and purposes of this will be apparent to persons acquainted with apparatus of this general type upon reading the following specification and inspecting the accompanying drawings, in which.

DETAILED DESCRIPTION

Figure 1:
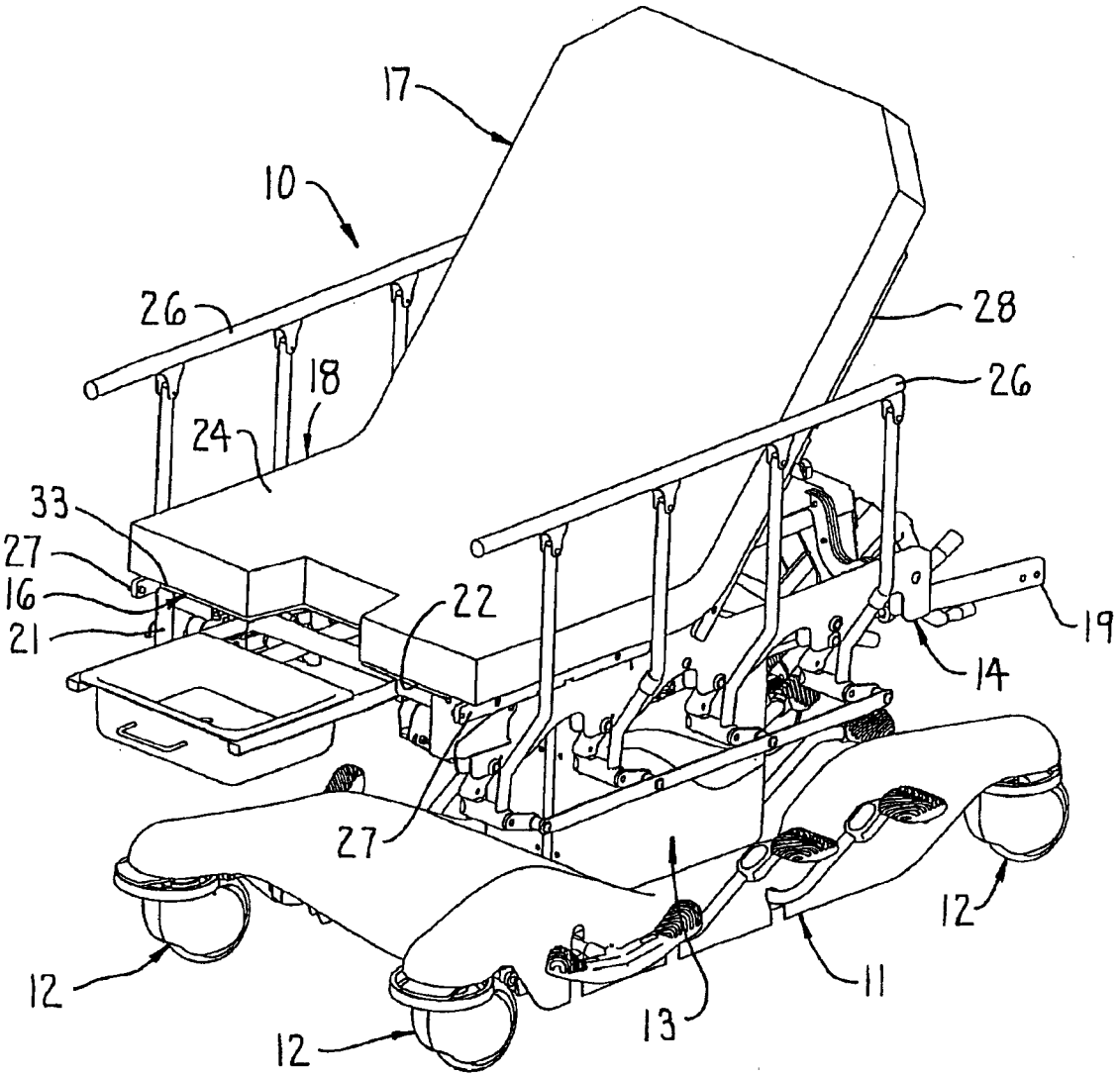
FIG. 1 is an isometric view of a patient supporting apparatus minus the foot section and illustrating a fluid collecting receptacle in the deployed position beneath the perineal edge of the seat section.

Certain terminology will be used in the following description for convenience in reference only and will not be limiting. The words "up", "down", "right" and "left" will designate directions in the drawings to which reference is made. The words "head end" and "foot end" of the bed will refer to, respectively, the right end of the bed and the left end of the bed illustrated in FIG. 1. The words "in" and "out" will refer to directions toward and away from, respectively, the geometric center of the device and designated parts thereof. Such terminology will include derivative and words of similar import.

Figure 11:
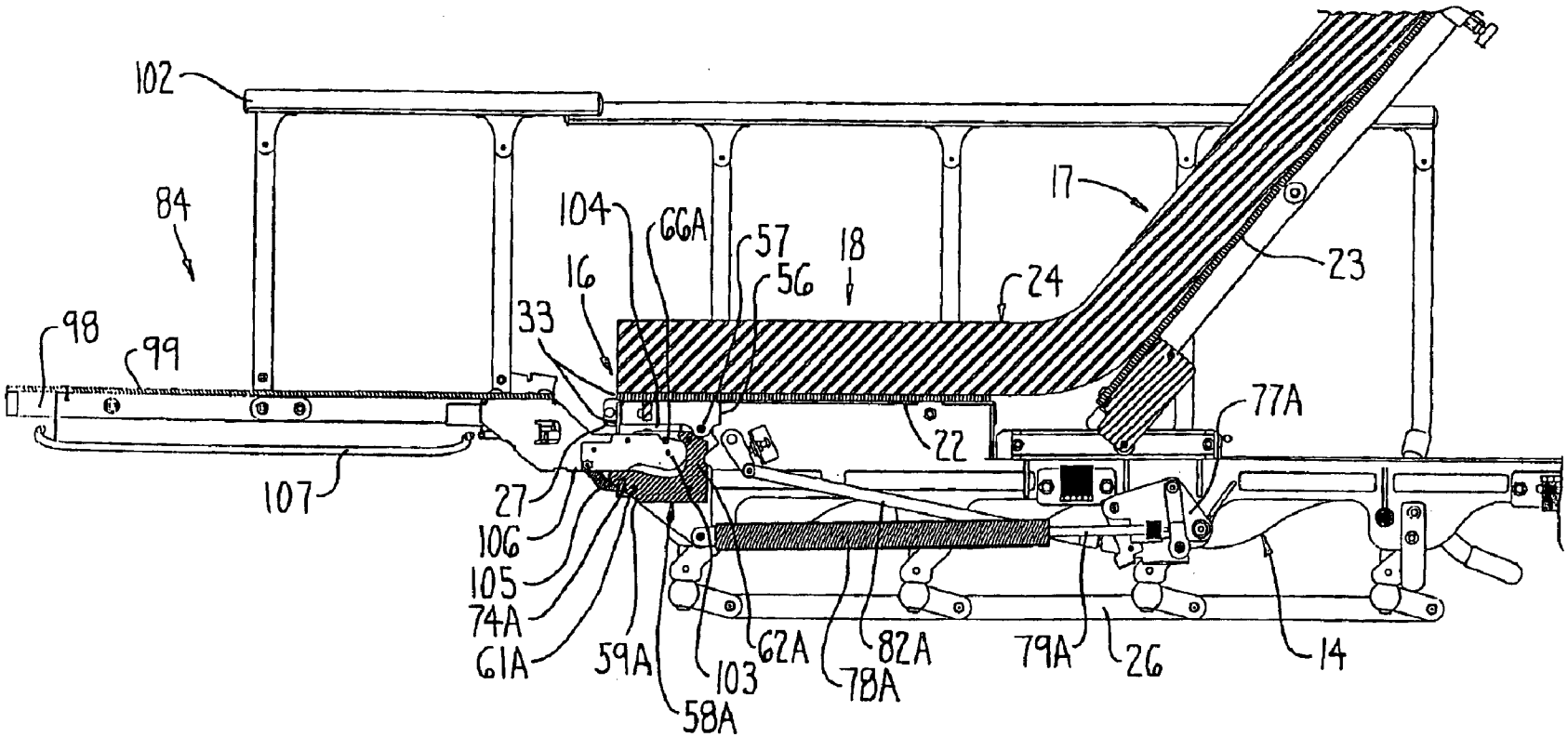
FIG. 11 is a longitudinal sectional view through the patient supporting apparatus with a foot section mounted thereto.

FIG. 1 illustrates a patient supporting apparatus 10 embodying the invention. The patient supporting apparatus 10 includes a base 11 supported on plural castered wheels 12. An upstanding pedestal 13 is mounted on the top side of the base 11 and includes a conventional jack system (not illustrated) for raising and lowering a frame 14. The frame 14 has thereon a patient support deck 16 consisting of a head section 17 and a seat section 18 as illustrated in FIG. 11. The frame 14 specifically includes a pair of elongate and parallel support frame members 19 and 20 as illustrated in broken lines in FIG. 2. As illustrated in broken lines in FIG. 2, a deck plate 22 is supported on and is fastened to an upper extremity of each of the elongate support frame members 19 and 21. The deck plate 22 is oriented in the seat section 18 whereas a further deck plate 23 illustrated in FIG. 11 is oriented in the head section of the patient support deck 16. A mattress 24 is supported on the patient support deck 16.

The patient supporting apparatus 10 includes elevatable side rails 26 independently mounted on respective elongate support frame members 19 and 21. In addition, an auxiliary elongate rail 27 is secured to each of the elongate support frame members 19 and 21 and extends coextensively with at least the seat section 18. A further auxiliary elongate rail 28 is supported on the deck plate 23 of the head section 17.

Further details of the patient supporting apparatus 10 can be found in co-pending application Ser. No. 09/592,040, filed on Jun. 12, 2000. The brakes operatively associated with the castered wheels can be found in co-pending application Ser. No. 09/592,038, filed on Jun. 12, 2000. A safety side rail configuration disclosed in U.S. Pat. No. 6,360,385 can be substituted for the safety side rail configuration 26 disclosed herein. Thus, further discussion of this componentry is believed unnecessary, but the subject matter of pending application Ser. Nos. 09/592,038 and 09/592,040 and the subject matter of U.S. Pat. No. 6,360,385 is to be incorporated herein by reference.

Figure 2:
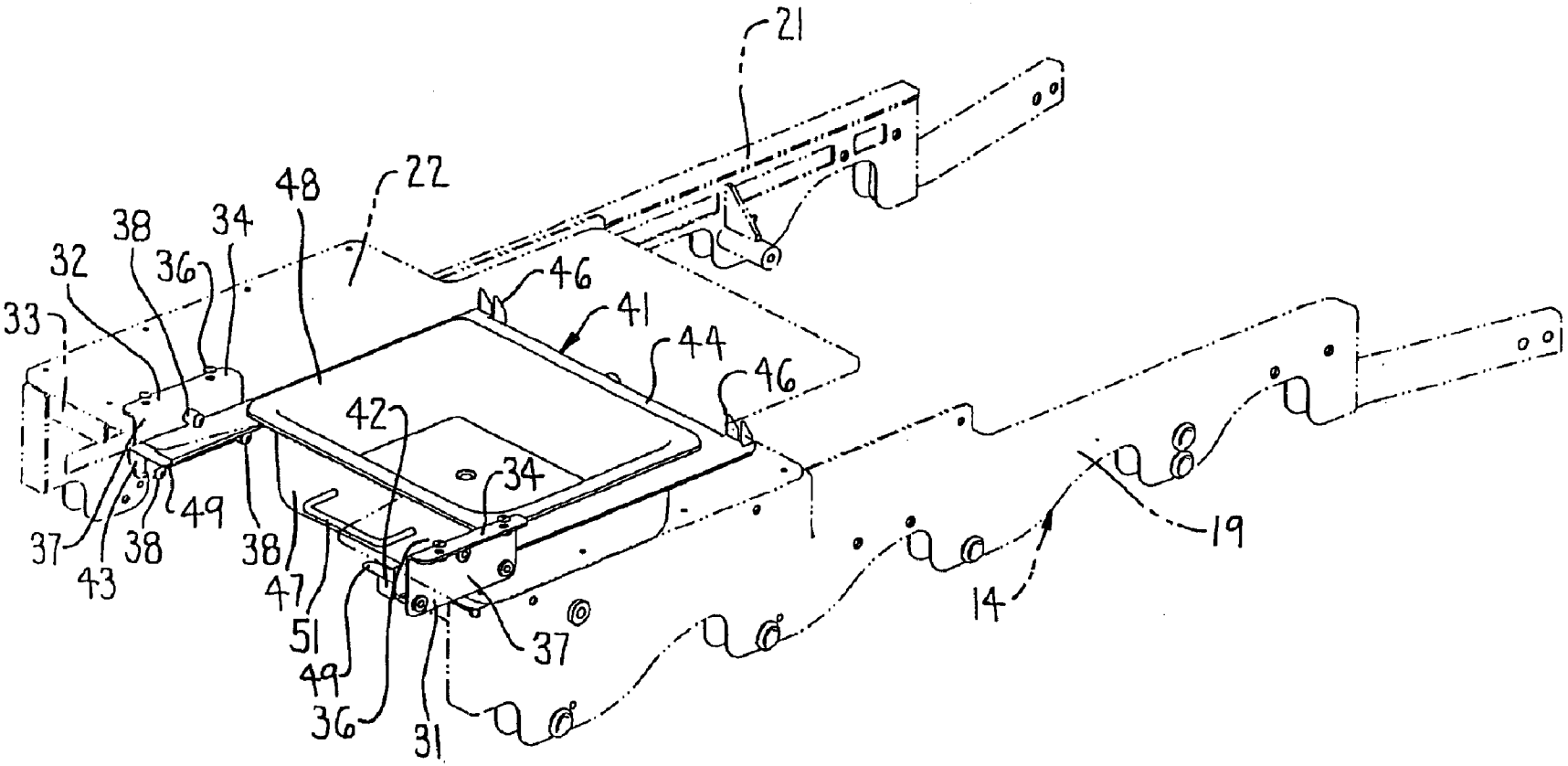
FIG. 2 is an isometric view illustrating the fluid receiving receptacle in a first position and a first position of a supporting frame on which it is slidably supported.

Referring now to FIG. 2, a pair of laterally spaced support brackets 31 and 32 are each secured to a respective elongate support frame member 19 and 21 or to the underside of the patient support deck, particularly, the deck plate 22 adjacent an edge thereof remote from the head section, otherwise known as the perineal edge 33 of the seat section 18. In this particular embodiment, each of the support brackets 31 and 32 are generally of an inverted L shape wherein one leg of the L is longer than the other. In this particular embodiment, the shorter leg 34 is secured by fasteners 36 to the underside of the deck plate 22. The longer legs 37 are oriented in parallel vertical planes which extend parallel to a longitudinal axis of each of the elongate support frame members 19 and 21. In this particular embodiment, each of the long legs 37 have a set of three rollers 38 rotatably supported about spaced horizontal axes, the points of intersection of the axes with the vertical plane of the legs 37 defining an equilateral triangle, the apex of the triangle being elevated above the base of the triangle. The axes of rotation of the respective and corresponding rollers in each set are coaxial.

A U-shaped frame 41 is supported for movement with respect to the rollers 38. More specifically, the U-shaped frame 41 includes a pair of parallel legs 42 and 43 and an interconnecting bight 44 connecting one end of each leg 42 and 43 to each other. In this particular embodiment, a longitudinal axis of the bight 44 is perpendicular to a longitudinal axis of each of the legs 42 and 43. In addition, the axes of rotation for the rollers 38 oriented on the base of the aforesaid equilateral triangle are in a first horizontal plane and the axis of rotation at the apex of the triangle is in a second horizontal plane so that the legs 42 and 43 are configured to extend between the two planes, the bottom rollers operatively engaging the underside of the legs 42 and 43 whereas the roller 38 at the apex engages the top surface of the legs 42 and 43 as illustrated in FIG. 2. The bight 44 includes a pair of laterally spaced stops 46 that are upstanding from the top surface thereof.

An open topped liquid collecting receptacle 47 is configured to mount onto the frame 41 and be movable with respect to the frame 41. More specifically, the receptacle 47 has an outwardly extending flange 48 adjacent the upper edge thereof, sections of the flange overlapping the respective upper surfaces of the legs 42, 43 and bight 44. The flange 48 is configured to slide on and with respect to the upper surfaces of the legs 42 and 43. A stop 49 is provided on each leg 42 and 43 at an end thereof remote from the bight 44 to limit the relative sliding movement of the receptacle 47 with respect to the U-shaped frame 41. For convenience, a handle 51 is mounted on one of the side walls of the receptacle 47, particularly the side wall of the receptacle which is facing away from the head section 17 of the patient support deck.

Figure 3:
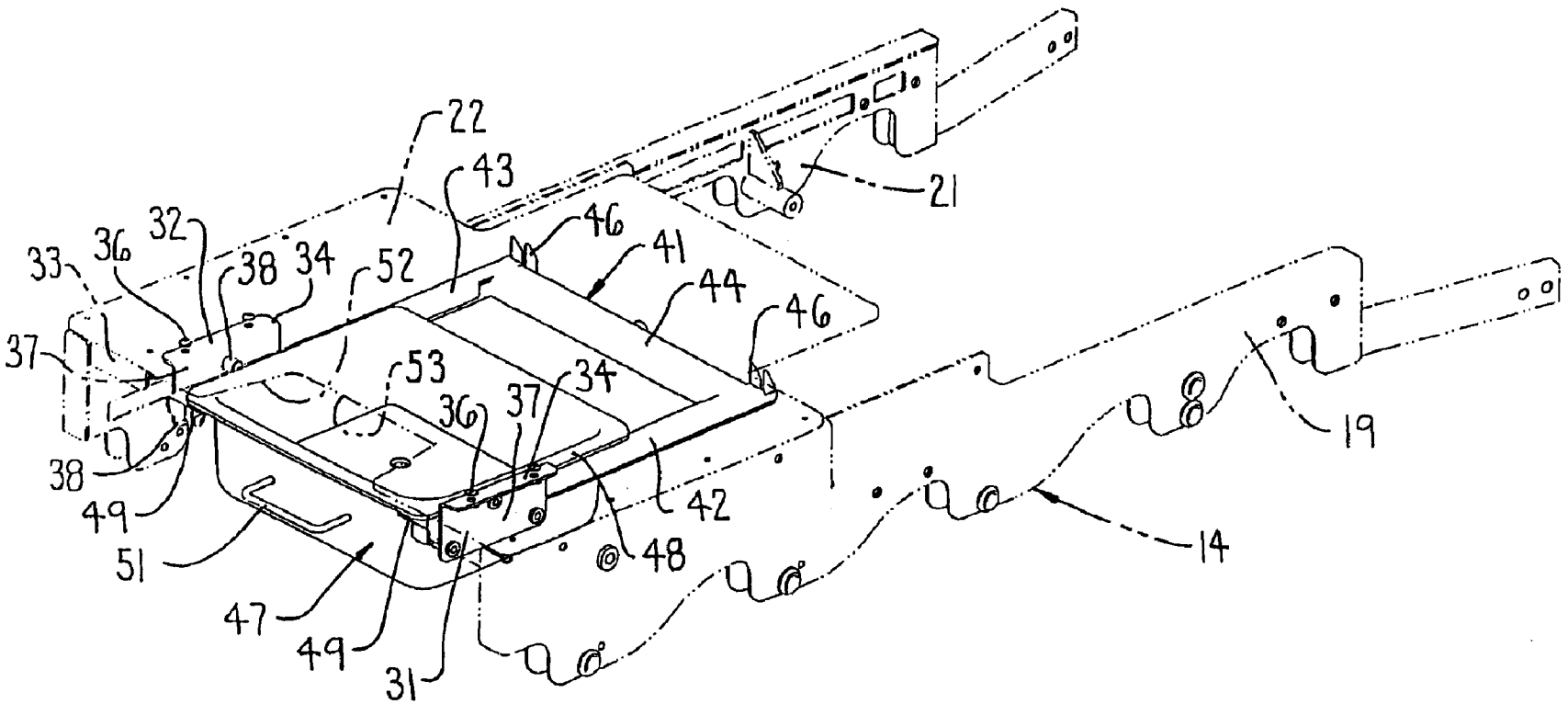
FIG. 3 is an isometric view illustrating a second position of the fluid receiving receptacle relative to the frame.

FIG. 3 is similar to FIG. 2 except that the receptacle 47 has been moved with respect to the U-shaped frame 41 until the outside surface of the side walls of the receptacle have come into engagement with the stops 49 on the legs 42 and 43. Such relative movement occurs by reason of a manual force being applied to the handle pulling the receptacle to the left. When the receptacle 47 and the supporting U-shaped frame 41 is in the position illustrated in FIG. 2, the weight of the receptacle and frame create a generally clockwise moment relative to the supporting rollers 38 such that the friction resisting movement of the legs 42 and 43 relative to the rollers is greater than the friction between the flange 48 on the receptacle 47 and the upwardly facing surfaces of the legs 42 and 43. As a result, the receptacle 47 will slide to the position illustrated in FIG. 3 while the U-shaped frame 41 remains in its original position.

Figure 4:
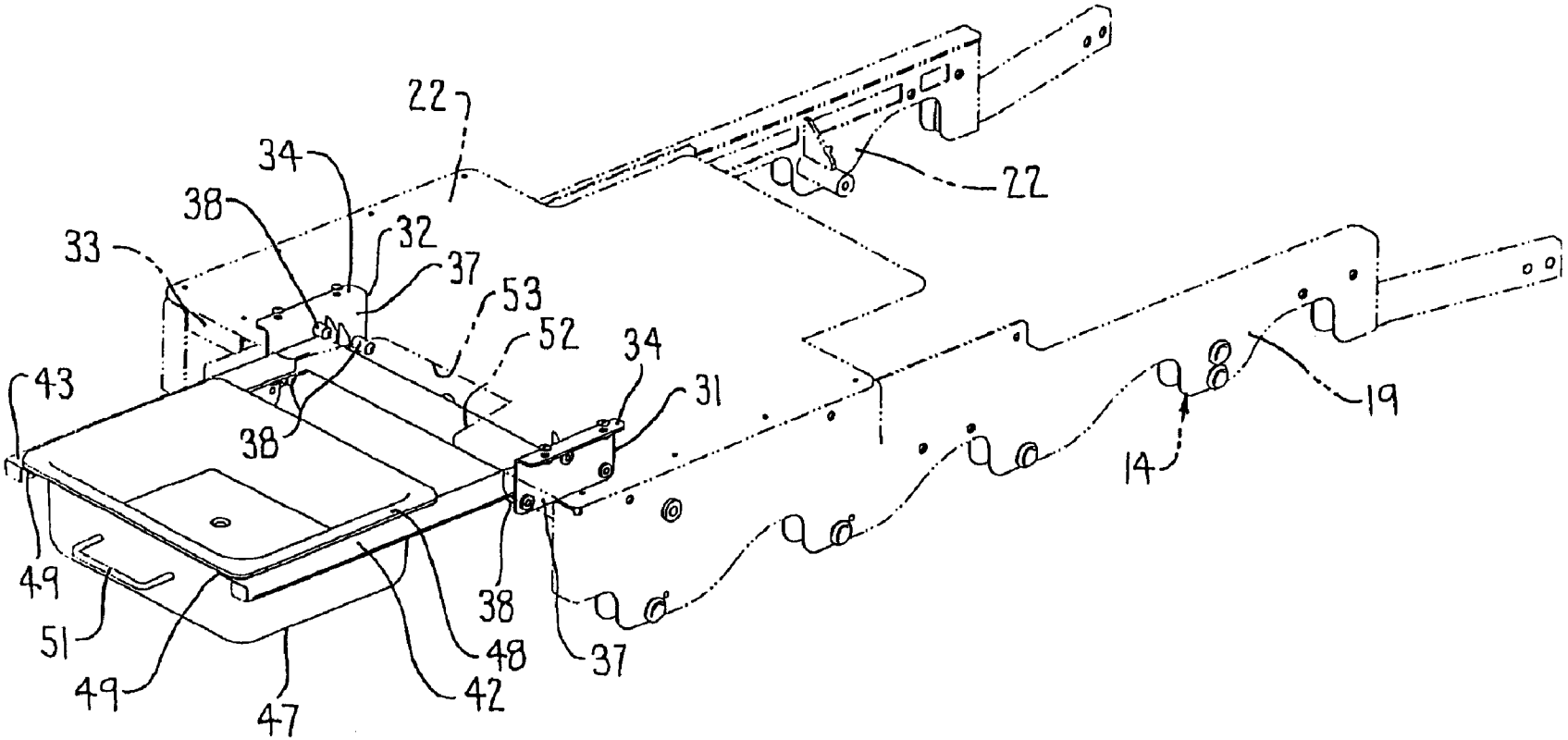
FIG. 4 is an isometric view illustrating a third position of the fluid receiving receptacle and a second position of the frame relative to the supporting structure therefor.
Figure 5:
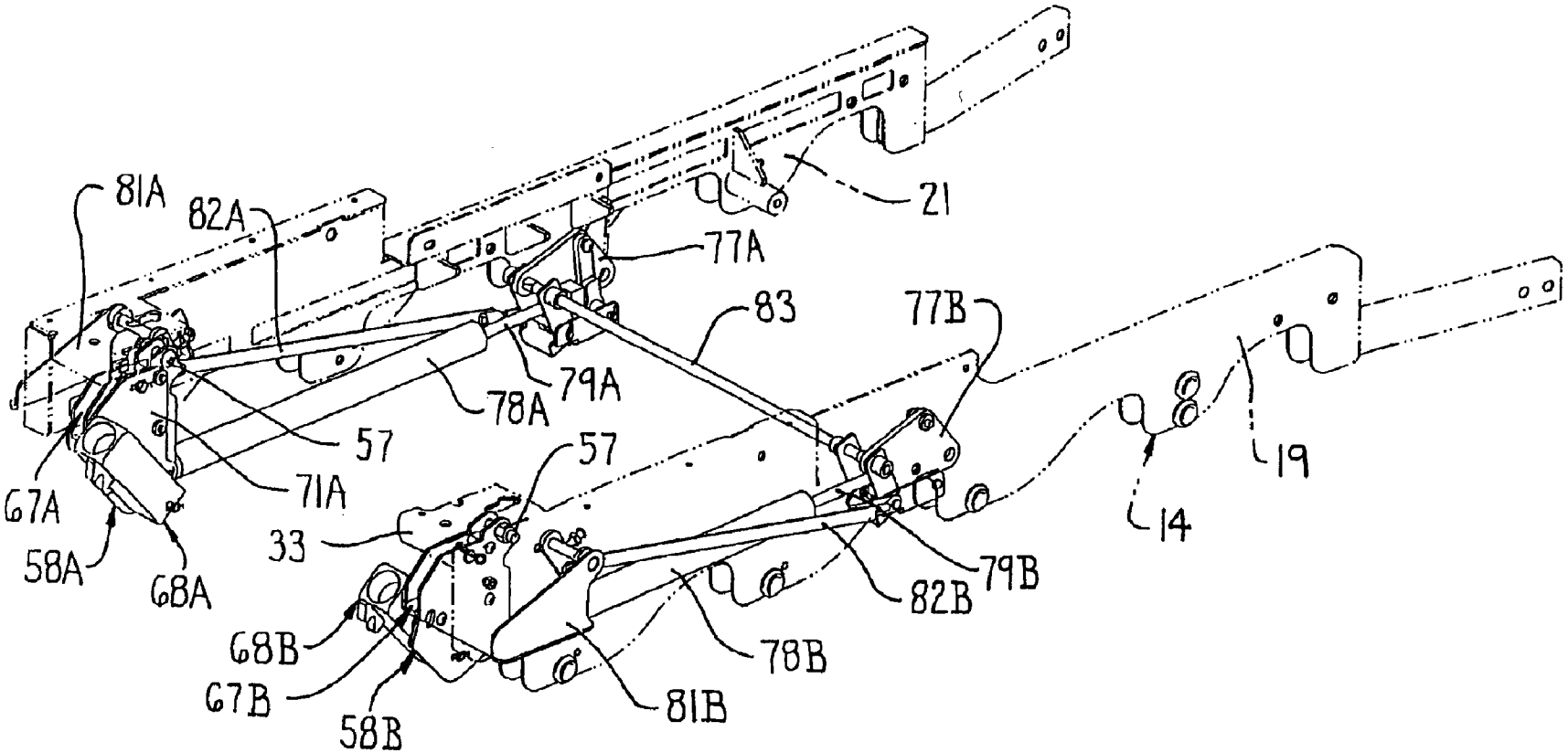
FIG. 5 is an isometric view of a fastener arrangement for facilitating separate connection of first and second patient supporting devices.

FIG. 4 is similar to FIG. 3 except that a continued force applied to the handle 51 drawing the receptacle to the left will also cause the U-shaped frame 41 to be drawn to the left by reason of engagement of the wall of the receptacle with the stops 49. The entire assembly of receptacle 47 and U-shaped frame 41 will be allowed to move to the left until the stops 46 come into engagement with the respective rollers at the apex of the triangular array thereof. This compact assembly of receptacle 47 and U-shaped frame 41 and the mount therefor enables the receptacle 47 to be stowed completely beneath the deck plate 22 of the seat section 18. As is illustrated in broken lines in FIG. 3, the perineal edge 33 of the deck support plate 22 includes a conventional notch 52 therein. In this particular embodiment, the receptacle 47 in the FIG. 2 position is oriented between the head section 17 and the bottom 53 of the perineal notch 52.

Figure 6:
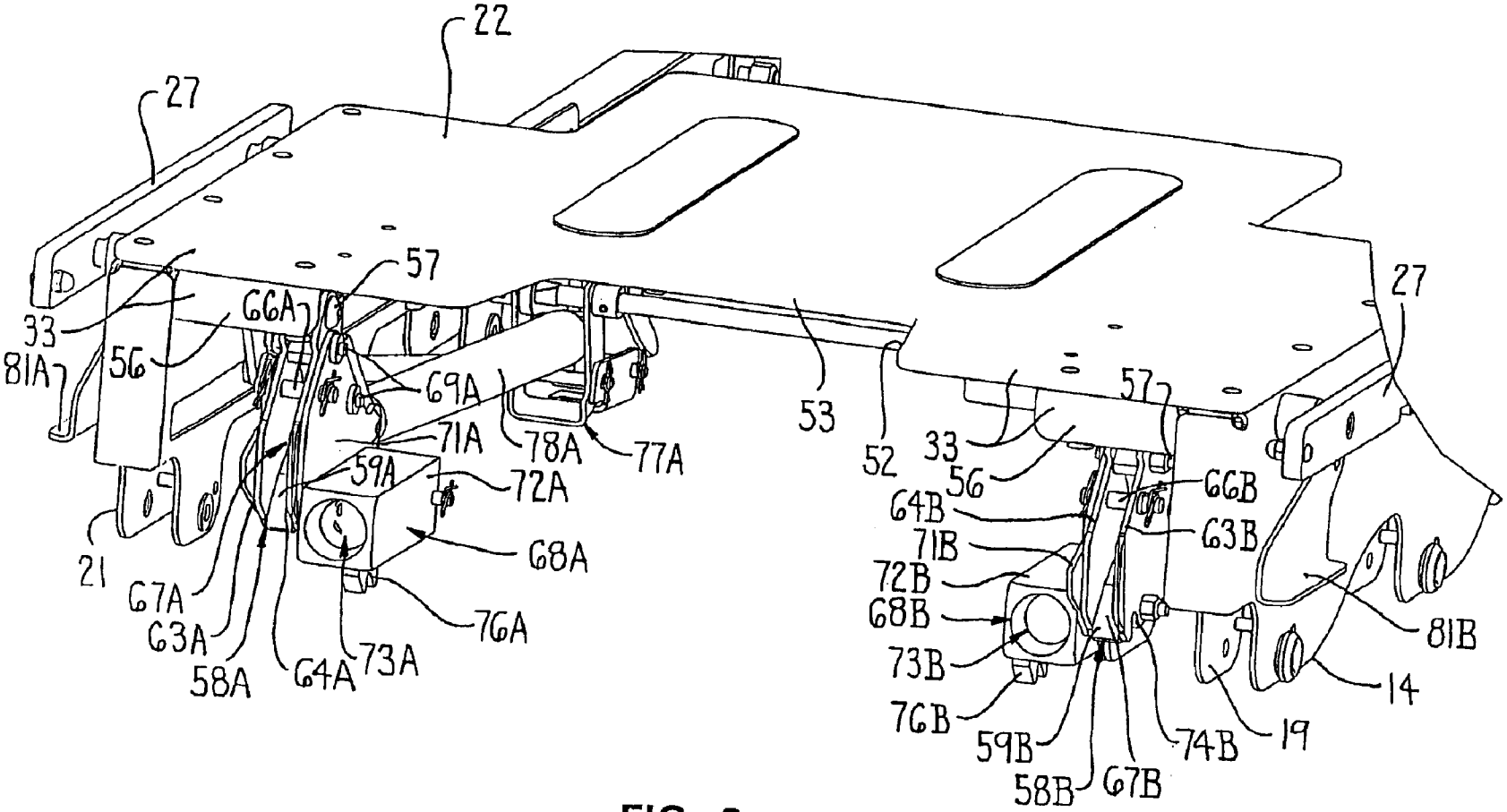
FIG. 6 is an isometric view of the arrangement illustrated in FIG. 5, but viewing the structure from a different perspective and with the coupling elements being in a first position thereof.
Figure 7:
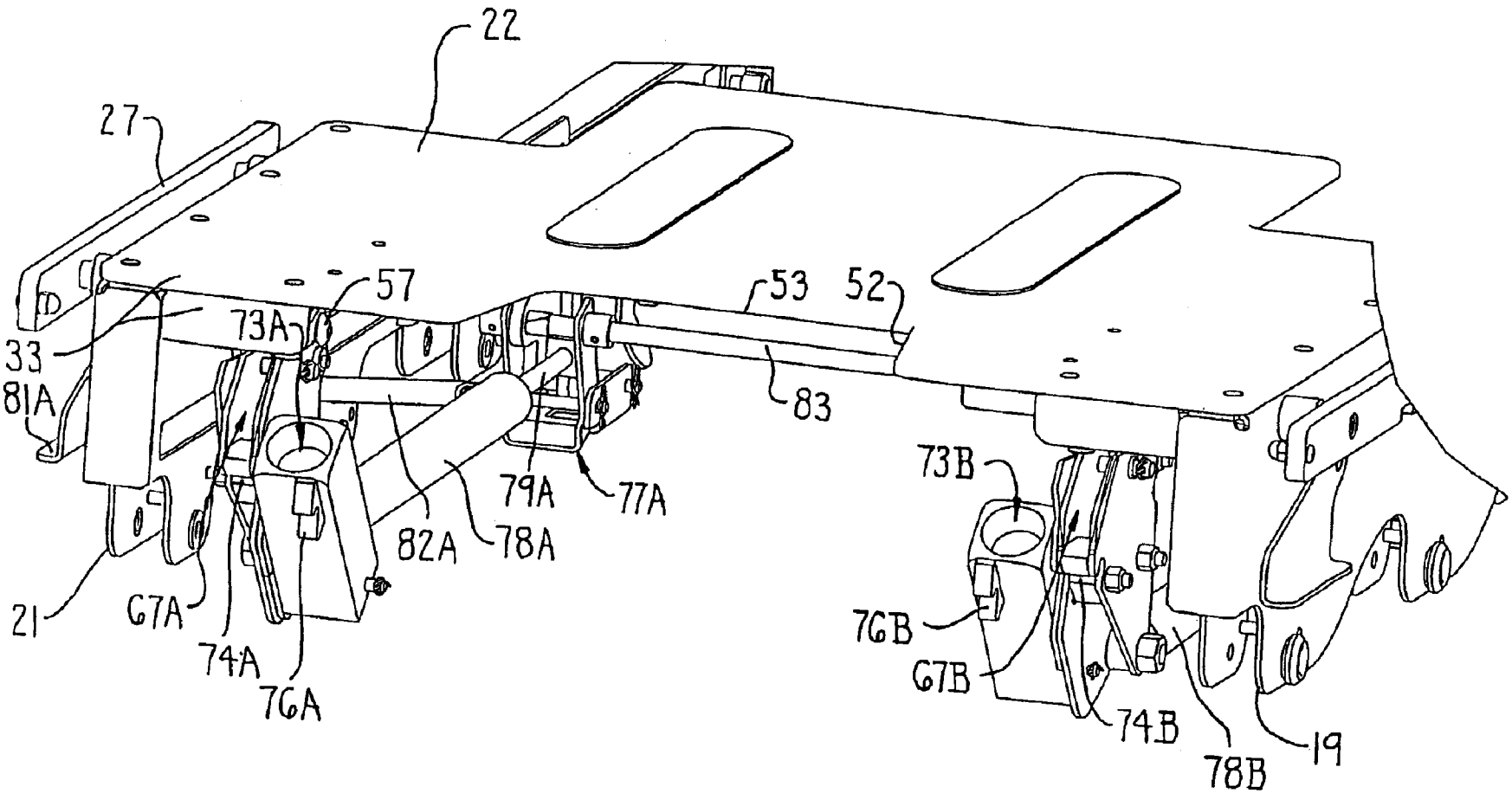
FIG. 7 is a view like FIG. 6, but with the coupling elements having been shifted to a second position thereof.

As illustrated in FIGS. 6 and 11, a pair of laterally spaced brackets 56 are secured to the underside of the deck plate 22 of the seat section 18 adjacent respective elongate support frame members 19 and 21. Each bracket 56 includes an axle 57 coaxial with each other and pivotally supports respective left support bracket 58A and right support bracket 58B. The axis of the coaxial axles 57 extends generally perpendicular to a longitudinal axis of the support frame members 19 and 21. Support brackets 58A and 58B are mirror images of each other and are, as illustrated in FIGS. 6 and 7, oriented on the left and right sides of the perineal notch 52. In fact, the brackets 58A and 58B are oriented between the respective lateral sides of the receptacle 47 and the respective elongate support frame members 19 and 21. The receptacle 47 and the support structure therefor has been omitted from FIGS. 6 and 7 in order to facilitate clarity in this description.

Since the support brackets 58A and 58B are mirror images of one another, only the support bracket 58A will be described in detail with each reference numeral used in the descriptive text being suffixed by the letter "A". Corresponding reference numerals for the support bracket 58B will be illustrated in the drawings, but with the suffix "B" added thereto.

The support bracket 58A includes a central generally L-shaped member 59A which includes a generally horizontal leg portion 61A and a vertically oriented leg portion 62A as best illustrated in FIG. 11. The L-shaped member 59A is straddled by a pair of flat plates 63A and 64A that are each pivotally suspended from the axle 57. A pin 66A is secured to each of the plates 63A and 64A and traverses the gap between the plates defined by the thickness of the L-shaped member 59A. The flat plates 63A, 64A and the L-shaped member 59A therebetween define a first coupling element 67A. A second coupling element 68A is fixedly fastened to the first coupling element 67A by a plurality of fasteners 69A. More specifically, the second coupling element 68A includes a flat plate 71A coupled to the flat plate 64A on a side thereof remote from the L-shaped member 59A. A block 72A is secured to the flat plate 71A and includes a socket 73A therein opening outwardly in a direction generally facing away from the perineal edge 33. Each of the first and second coupling elements 67A and 68A include respective abutments 74A (FIG. 11) and 76A.

Spaced from the perineal edge 33 toward the head section is a further bracket 77A fixedly secured to the elongate support frame member 21. A spring locking gas spring 78A is connected to and is oriented between the first coupling element 67. In this particular embodiment, the body of the spring locking gas spring 78A is secured to the first coupling element 67A whereas the rod part 79A is secured to the bracket 77A. A manually engageable handle 81A is pivotally secured to the elongate support frame member 21 adjacent the perineal edge 33 and is connected by means of a linkage 82A to a mechanism on the rod part 79A of the spring locking gas spring 78A to facilitate operation of the spring locking gas spring 78A in a well known manner. The spring locking gas spring 78A and the handle activating mechanism are conventional and the gas springs are available through Stabilus GmbH in Gastonia, N.C. under the trademark BLOC-O-LIFT. Manipulation of the handle 81A will enable adjustable movement of the support bracket 58A to and between the positions illustrated in FIGS. 6 and 7. A rod part 83 unites the operative mechanism controlling the spring gas springs 78A and 78B for simultaneous operation so that the first and second coupling elements will remain operative in unison.

The relative angle of movement of the respective first and second coupling elements 67A, 67B and 68A, 68B is in the range of 35 to 60° with the preferred angle being at 50°.

Figure 8:
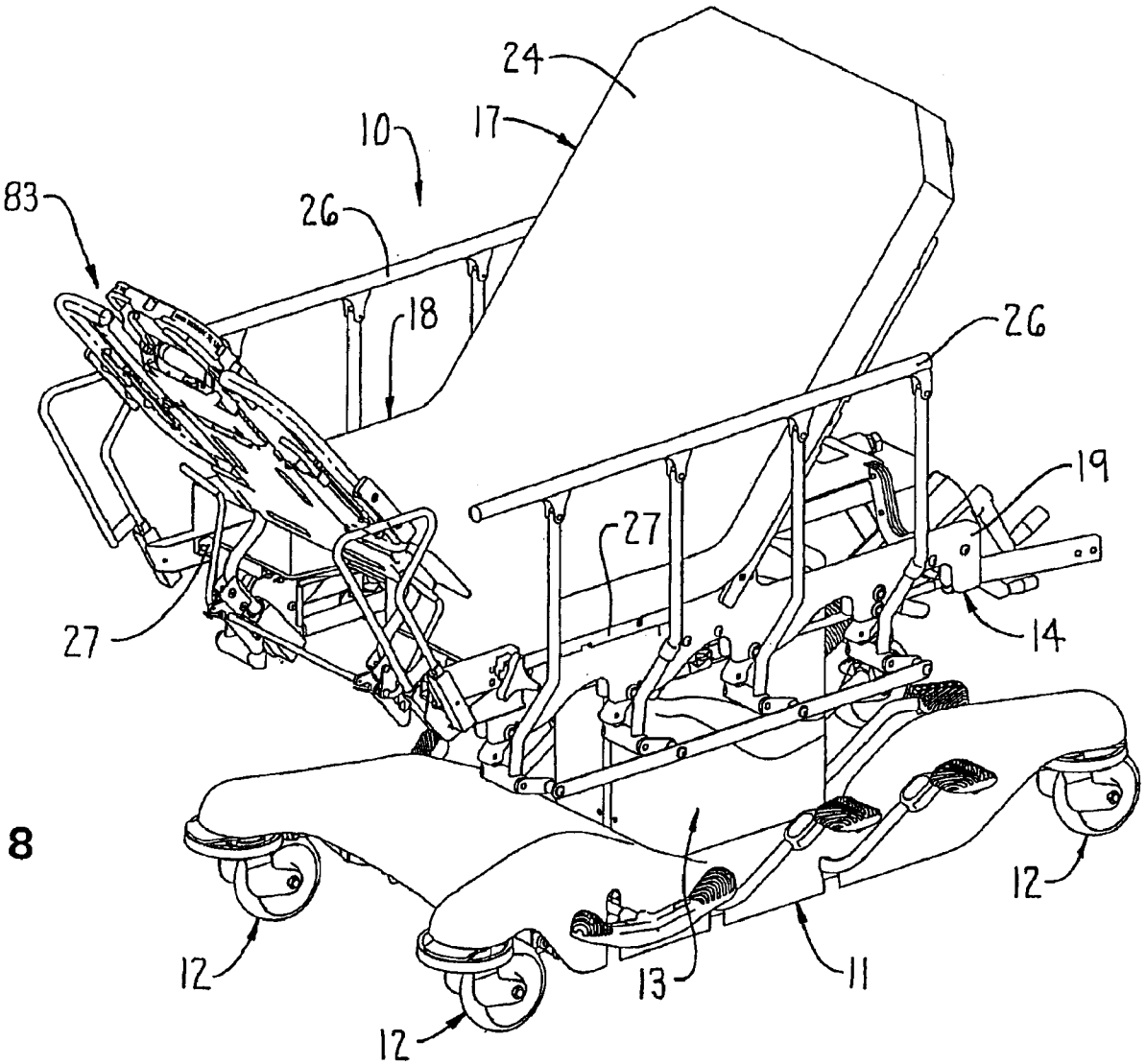
FIG. 8 is an isometric view similar to FIG. 1 except that the fluid receiving receptacle has been moved to a stowed position beneath the seat section and one of a plural number of foot sections has been inserted into the coupling elements.
Figure 9:
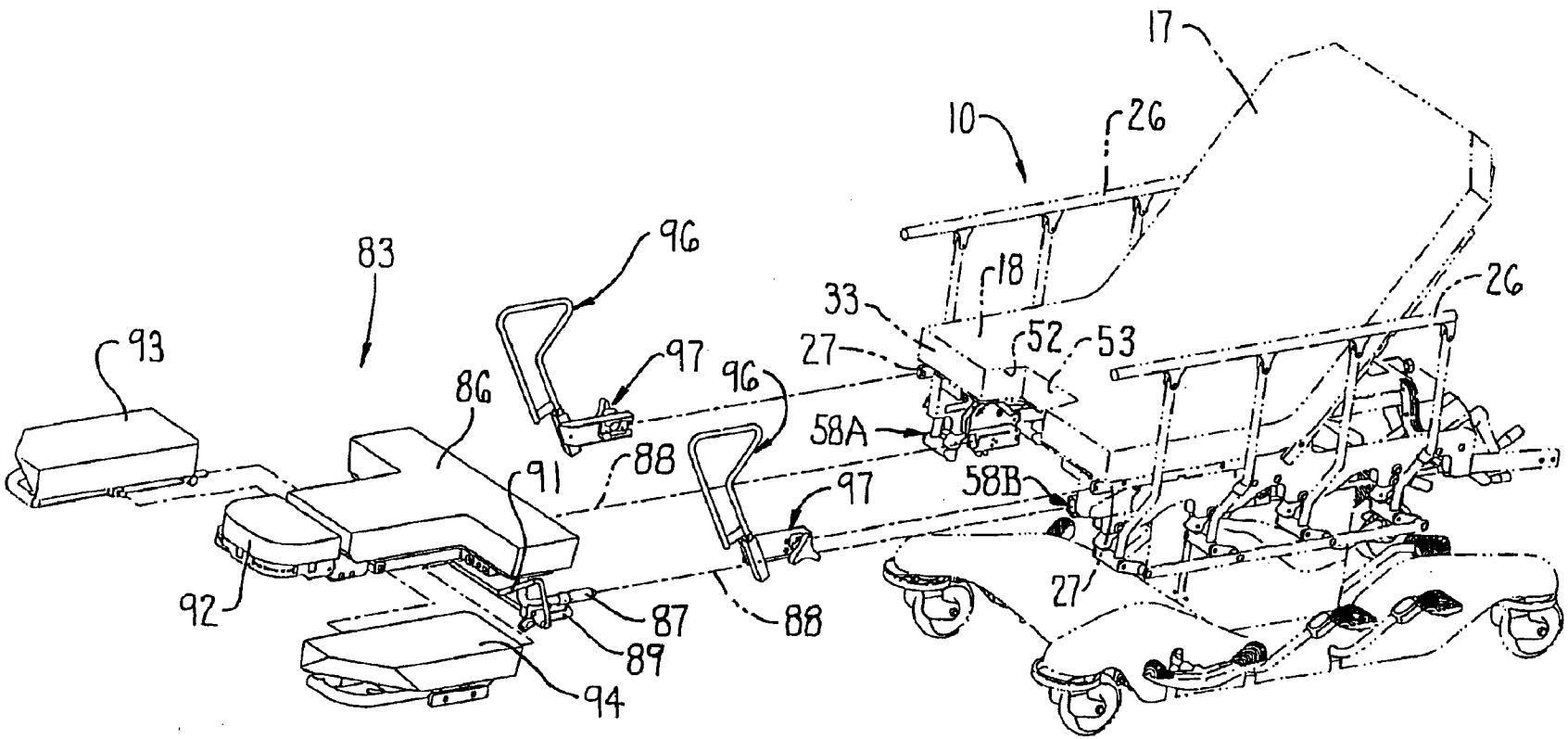
FIG. 9 is an exploded view of the assembly illustrated in FIG. 8 particularly illustrating a foot end fowler separated from the patient supporting bed.
Figure 10:
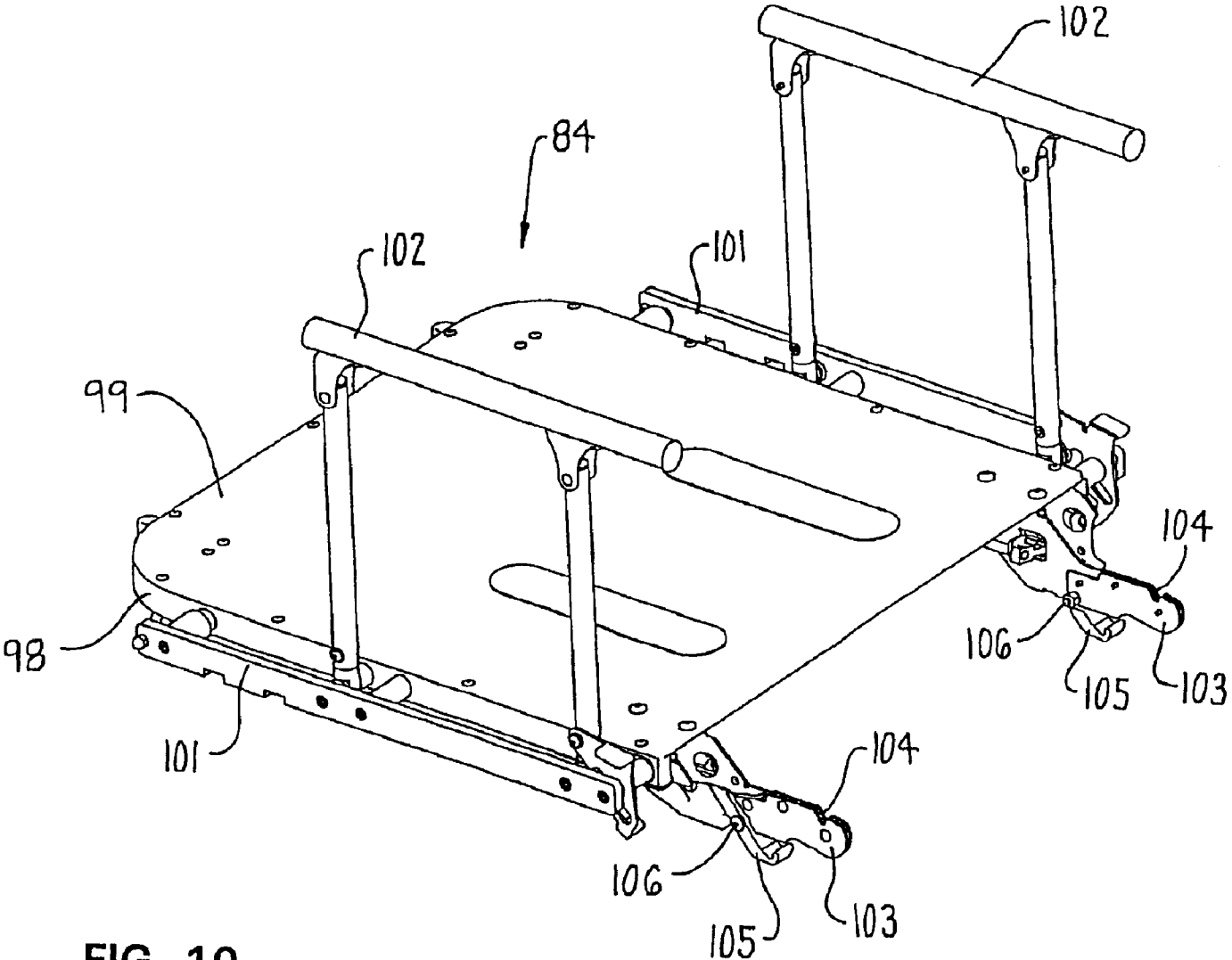
FIG. 10 illustrates an isometric view of a foot section that can be operatively connected to the patient supporting apparatus in place of the foot end fowler device illustrated in FIGS. 8 and 9.

The support brackets 58A and 58B are configured to operatively connect to differing foot end assemblies, such as a foot end fowler mechanism 83 illustrated in FIG. 9 or a foot piece 84 illustrated in FIG. 10. The foot end fowler 83 is illustrated in FIG. 8 whereas the exploded view thereof is illustrated in FIG. 9.

The foot end fowler assembly 83 includes a T-shaped section 86 where the crosswise portion of the "T" is configured to mate with the perineal edge 33 of the seat section 18. In order to facilitate the connection, the crosswise portion of the "T" includes a pair of laterally spaced probes 87 each adapted to be aligned with a respective axis 88 of a socket 73A and 73B so that upon reception of the probes 87 into the respective sockets 73A and 73B, the stem portion of the "T" will extend away from the perineal edge 33. Each of the probes 87 has a latch mechanism 89 pivotally supported thereon and operatively movable by manipulation of a handle 91. The respective latch members 89 are operatively engageable with the abutments 76A and 76B to facilitate a locking of the foot end fowler assembly 83 to the respective support brackets 58A and 58B. The distal end of the stem of the "T" of the T-shaped section 86 includes an articulatable head piece for supporting the head of a patient and enabling manipulative movements of the head piece to accommodate various orientations of the head of the patient relative to the stem portion of the T-shaped section 86. The head piece configuration is disclosed in pending application Ser. No. 10/047,743, filed Jan. 15, 2002. Releasable shoulder supports 93 and 94 are fastenable to the T-shaped section 86 in any conventional way to fully support the back part of a patient. If surgery, for example, is to be performed on a patient's shoulder, a respective one of the shoulder supports 93 and 94 may be removed for that purpose.

In order to provide additional safety for the patient seated on the patient support deck when the foot end fowler assembly 83 is connected to the patient supporting apparatus 10, an auxiliary set of side rails 96 can be clamped to a respective auxiliary elongate rail 27 by a conventional clamping mechanism 97. The auxiliary set of side rails 96 are configured to extend above the patient support deck in a manner illustrated in FIG. 8 so that when the foot end fowler assembly 83 is oriented between positions wherein it is horizontally aligned with the seat to positions inclined with respect to the seat section, the auxiliary set of side rails will prevent patient movement beyond the lateral edges of the foot end fowler assembly 83.

The foot piece assembly 84 (FIGS. 10 and 11) include a frame assembly 98 which includes a patient support deck 99, an auxiliary set of elongate rails 101 oriented along lateral edges thereof and an elevatable side rail assembly 102. The frame includes a pair of laterally spaced probes 103 each configured to be received into a respective coupling element 67A and 67B. Each of the probes 103 has a notch 104 therein and configured to receive the respective pin 66A and 66B when the probes 103 are inserted into the respective coupling elements 68A and 68B. As illustrated in FIG. 11, the L-shaped member 59A is recessed below the pin 66A so as to facilitate the distal end of the probe 103 being fitted under the pin 66A so that when the foot piece assembly 84 is leveraged on the distal end of the horizontal leg of the L-shaped member 59A, the notch 104 will move into a coupling relation with the pin 66A.

The frame assembly 98 also includes a latch member 105 associated with each probe 103. Each latch member 105 is pivotally supported on the probes 103 about respective axles 106 and are simultaneously pivoted about the axle 106 by a handle mechanism 107 illustrated in FIG. 11. The latch members 105 are configured to operatively engage a corresponding abutment 74A and 74B on the coupling elements 67A and 67B. Thus, when the latch members 105 are appropriately engaged with the abutments 74A and 74B, the foot piece assembly 84 will be locked to the respective bracket assemblies 58A and 58B.

In operation, the coupling elements 67A and 67B are configured so that the axis thereof extends between a horizontal plane and an angle downwardly inclined from the horizontal plane to the limit of movement of the respective support brackets 58A and 58B when the foot piece assembly 84 is appropriately secured thereto. The respective axes of the sockets 73A and 73B are configured to move from a horizontal plane upwardly to the extent permitted by the support brackets 58A and 58B wherein the respective axes of the sockets 73A and 73B lie in a plane which is inclined to the horizontal. As stated above, the preferred angle of inclination of the foot end fowler assembly 83 is 50° above the horizontal whereas the angle of decline of the foot piece assembly 84 is 50° below the horizontal.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A patient supporting apparatus, comprising:

a base;

a pair of elongate generally parallel extending and laterally spaced support frame members;

a pedestal mounted to and extending between a top side of said base and each of said support frame members;

a patient support deck having a head section and a seat section, said seat section including a deck plate oriented in a horizontal plane mounted to and extending between said support frame members;

a pair of laterally spaced support brackets on at least one of said base and said patient support deck adjacent to said seat section along a side thereof remote from said head section;

a guideway on each of said support brackets, said guideways extending generally horizontally;

a frame supported on said guideways for movement along a longitudinal path in a direction parallel to said elongate frame members between a first position stowed beneath said deck plate and a second position extending from beneath said deck plate on a side remote from said head section, said frame having a track thereon extending parallel to said longitudinal path; and a receptacle mounted on said track for movement relative to said track in a direction parallel to said longitudinal path to positions at and between a third position stowed entirely beneath said deck plate and a fourth position wherein the entire receptacle is free of obstruction from above by said deck plate.

2. The patient supporting apparatus according to claim 1, wherein said receptacle includes a handle.

3. The patient supporting apparatus according to claim 1, wherein each of said guideways include a plurality of rollers spaced horizontally from one another with at least one of said rollers having an axis of rotation contained in a first horizontal plane that is elevationally spaced from a second horizontal plane containing axes of rotation of at least two other rollers.

4. The patient supporting apparatus according to claim 3, wherein said plurality of rollers is three rollers defining each guideway, each axis of rotation of each of said rollers which define one guideway being axially aligned with a corresponding roller in the other of said guideway.

5. The patient supporting apparatus according to claim 3, wherein said frame is generally of a U-shape having a pair of parallel horizontally laterally spaced legs and a horizontally extending bight member interconnecting one end of each of the legs to one another, each horizontal leg having an elongate guide element which is positionally oriented between said first and second horizontal planes and resting on the rollers in the lowermost one of said planes.

6. The patient supporting apparatus according to claim 5, wherein the rollers in each guideway are clustered adjacent said side of said seat section remote from said head section, and wherein said frame is supported on said rollers for movement between said first and said second positions relative to said side of said seat section remote from said head section, said first position corresponding to said bight member being horizontally spaced from the roller clusters, said second position corresponding to said bight member being juxtaposed said roller clusters.

7. The patient supporting apparatus according to claim 6, wherein first and second steps are provided on said frame for limiting the movement of said frame relative to said side of said seat section to said first and said second positions.

8. The patient supporting apparatus according to claim 5, wherein said receptacle has an open top and a radially outwardly extending flange encircling said open top with portions thereof being removably and slidably supported on an upwardly facing surface of each of said legs of said frame which define said track.

9. The patient supporting apparatus according to claim 8, wherein a length of said portions of said flanges supported on said upwardly facing surface of each of said legs of said frame is generally less than a majority of the length of each of said upwardly facing surfaces in order to facilitate a sliding movement of said receptacle relative to said frame between said third and said fourth positions.

10. The patient supporting apparatus according to claim 9, wherein third and fourth stops are provided for limiting the relative movement between said receptacle and said frame.

11. The patient supporting apparatus according to claim 1, wherein said receptacle has an open top and a radially outwardly extending flange encircling said open top with portions thereof being removably and slidably supported on said guideway, a length of said portions of said flanges being generally less than a majority of the length of each of said guideways in order to facilitate a movement of said receptacle relative to said frame between said third and said fourth positions.

12. The patient supporting apparatus according to claim 11, wherein first and second stops are provided on said frame for limiting the movement of said frame relative to said side of said seat section to said first and said second positions, wherein said frame and said receptacle supported on said frame are configured so that when said receptacle is in said third position and when said frame is in said first position, said receptacle will be oriented entirely beneath said seat section and generally between said side of said seat section remote from said head section and said head section.

13. The patient supporting apparatus according to claim 12, wherein said side of said seat section remote from said head section includes a notch and wherein said configuration additionally accomplishes, when said receptacle is in said third position and when said frame is in said first position, an orienting of said receptacle entirely beneath said seat section so that said notch is unobstructed by structure of said frame and said receptacle.

14. The patient supporting apparatus according to claim 13, wherein said configuration additionally accomplishes, when said receptacle is in said third position and when said frame is in said first position, a cantilevering of said frame and said receptacle thereon from said guideways so that a combined weight of said frame and said receptacle will cause a frictional resistance to movement between said guideways and said frame to be greater that a frictional resistance to movement between said frame and said receptacle.

* * * * *

UNITED STATES PATENT AND TRADEMARK OFFICE

CERTIFICATE OF CORRECTION

PATENT NO. : 6,957,457 B2
APPLICATION NO. : 10/763851
DATED : October 25, 2005
INVENTOR(S) : Martin Stryker et al.

It is certified that error appears in the above-identified patent and that said Letters Patent is hereby corrected as shown below:

Column 10, line 8; change “greater that a” to ---greater than a---.

Signed and Sealed this

Fifth Day of February, 2008

JON W. DUDAS
*Director of the United States Patent and Trademark Office*